US012704263B2

(12) United States Patent
Lee et al.

(10) Patent No.: US 12,704,263 B2
(45) Date of Patent: Aug. 11, 2026

(54) COOKING APPLIANCE

(71) Applicant: SAMSUNG ELECTRONICS CO., LTD., Suwon-si (KR)

(72) Inventors: Sangjin Lee, Suwon-si (KR); Myoungkeun Kwon, Suwon-si (KR); Sangjin Kim, Suwon-si (KR); Changhoon Oh, Suwon-si (KR); Qasim Khan, Suwon-si (KR); Eungryeol Seo, Suwon-si (KR)

(73) Assignee: SAMSUNG ELECTRONICS CO., LTD., Gyeonggi-Do (KR)

( * ) Notice: Subject to any disclaimer, the term of this patent is extended or adjusted under 35 U.S.C. 154(b) by 770 days.

(21) Appl. No.: 18/156,446

(22) Filed: Jan. 19, 2023

(65) Prior Publication Data

US 2023/0160577 A1 May 25, 2023

Related U.S. Application Data

(63) Continuation of application No. PCT/KR2021/008060, filed on Jun. 28, 2021.

(30) Foreign Application Priority Data

Jul. 9, 2020 (KR) ..... 10-2020-0094177

(51) Int. Cl.
*F24C 15/00* (2006.01)

(52) U.S. Cl.
CPC ..... *F24C 15/006* (2013.01)

(58) Field of Classification Search
USPC ..... 237/12.6
See application file for complete search history.

(56) References Cited

U.S. PATENT DOCUMENTS 6,904,904 B2 6/2005 Walther et al.
7,228,857 B2 6/2007 Kim et al.
(Continued)

FOREIGN PATENT DOCUMENTS

CN 1628584 A 6/2005
CN 101600908 A 12/2009
(Continued)

OTHER PUBLICATIONS

Chinese Office Action Issued In CN Patent Application No. 202180058759.3, Issue Date Apr. 21, 2025, 16 Pages.
(Continued)

*Primary Examiner* — Steven B Mcallister
*Assistant Examiner* — John E Bargero
(74) *Attorney, Agent, or Firm* — CANTOR COLBURN LLP

(57) ABSTRACT

Disclosed herein is a cooking appliance capable of having improved aesthetics by reducing a size of an air outlet provided in a front side of a cabinet. The cooking appliance comprises a cabinet, a cooking chamber located inside the cabinet and comprising an open front side, a door configured to open and close the open front side of the cooking chamber, a blower fan disposed above the cooking chamber to blow air, an air outlet disposed in a gap between an upper end of the door and the cabinet, a duct provided to guide the air blown by the blower fan to the air outlet, and a circulation duct provided to connect the duct and a side of the blower fan to allow a portion of the air, which moves to the air outlet by the blower fan, to be re-introduced into the blower fan.

14 Claims, 9 Drawing Sheets

(56) References Cited

U.S. PATENT DOCUMENTS

| | | | | |
|---|---|---|---|---|
| 7,368,684 | B2 | 5/2008 | Kim et al. | |
| 7,708,007 | B2 | 5/2010 | Kim et al. | |
| 7,856,973 | B2 | 12/2010 | Kim et al. | |
| 8,333,183 | B2 | 12/2012 | Nam et al. | |
| 8,367,982 | B2 | 2/2013 | Yi et al. | |
| 8,866,840 | B2 | 10/2014 | Dahl et al. | |
| 9,022,017 | B2 | 5/2015 | Hyun et al. | |
| 9,310,996 | B2 | 4/2016 | Lee | |
| 9,348,504 | B2 | 5/2016 | Kwak et al. | |
| 9,696,042 | B2 | 7/2017 | Hasslberger et al. | |
| 9,746,187 | B2 | 8/2017 | Kim et al. | |
| 10,234,145 | B2 | 3/2019 | Chadwick et al. | |
| 10,542,128 | B2 | 1/2020 | Kang et al. | |
| 2006/0237425 | A1 | 10/2006 | Kim et al. | |
| 2011/0214661 | A1* | 9/2011 | Hyun | F24C 15/04 126/21 A |
| 2015/0241069 | A1 | 8/2015 | Brant et al. | |
| 2018/0094820 | A1 | 4/2018 | Verdoliva | |
| 2019/0223261 | A1 | 7/2019 | Hofmann et al. | |
| 2019/0286200 | A1 | 9/2019 | Ho et al. | |
| 2019/0301746 | A1 | 10/2019 | Catalogne et al. | |
| 2021/0190323 | A1 | 6/2021 | Greipel et al. | |

FOREIGN PATENT DOCUMENTS

| | | | |
|---|---|---|---|
| CN | 201630179 | U | 11/2010 |
| DE | 102004008463 | B3 | 3/2005 |
| EP | 0964208 | A1 | 12/1999 |
| EP | 1566594 | A1 | 8/2005 |
| EP | 1795812 | A2 | 6/2007 |
| EP | 2363648 | A2 | 9/2011 |
| EP | 3184909 | A2 | 6/2017 |
| EP | 3249304 | A1 | 11/2017 |
| KR | 200353573 | Y1 | 6/2004 |
| KR | 1020040061116 | A | 7/2004 |
| KR | 1020070017698 | A | 2/2007 |
| KR | 100698204 | B1 | 3/2007 |
| KR | 100717437 | B1 | 5/2007 |
| KR | 20100119128 | A | 11/2010 |
| KR | 20101531062 | B1 | 11/2010 |
| KR | 20110099541 | A | 9/2011 |
| KR | 1020110303641 | A | 9/2011 |
| WO | 2019238387 | A1 | 12/2019 |

OTHER PUBLICATIONS

Korean Office Action Issued In KR Application No. 10-2020-0094177; Mail Date May 28, 2025; 4 Pages.

Korean Office Action Issued In KR Application No. 10-2020-0094177; Mail Date Jan. 23, 2025; 14 Pages.

Search Report issued in European Patent Application No. 21850158.3; Application Filing Date Jun. 28, 2021; Date of Mailing Oct. 11, 2023 (10 pages).

International Search Report and Written Opinion for International Application No. PCTKR2021/006274 mailed Aug. 25, 2021; 16 pages.

* cited by examiner

COOKING APPLIANCE

CROSS-REFERENCE TO RELATED APPLICATIONS

This application is a continuation of International Application No. PCT/KR2021/008060 designating the United States, filed on Jun. 28, 2021, in the Korean Intellectual Property Receiving Office and claiming priority to Korean Patent Application No. 10-2020-0094177, filed on Jul. 29, 2020, in the Korean Intellectual Property Office, the disclosures of all of which are incorporated by reference herein in their entireties.

TECHNICAL FIELD

The present disclosure relates to a cooking appliance having improved aesthetics by reducing a size of an air outlet provided on a front side of a cabinet.

BACKGROUND ART

A cooking appliance is an appliance for heating and cooking a cooking object, such as food, and refers to a device capable of providing various functions related to cooking, such as heating, defrosting, drying, and sterilizing the cooking object. Examples of such a cooking appliance include an oven such as a gas oven or an electric oven, a microwave heating device (hereinafter referred to as a microwave), a gas range, an electric range, a gas grill, or an electric grill.

In general, an oven is an appliance configured to cook food using a cooking chamber that includes a heating device configured to apply heat to the cooking chamber, and a circulation fan configured to circulate the heat, which is generated by the heating device, in the cooking chamber.

In general, an oven includes a cabinet forming an exterior of the oven, and in which a front side is opened to form a cooking chamber, into which food to be cooked is put, and a door installed in the front of the cabinet to selectively open and close the cooking chamber.

The door may include a plurality of glass layers to prevent the heat inside the cooking chamber from being emitted outside and lowering a temperature of external surface of the door. Because the temperature of the door rises due to the heat inside the cooking chamber, an air inlet, through which outside air is sucked, may be provided in the door to prevent an increase in the temperature of the door. Air sucked through the air inlet may be discharged to the front of the cabinet through an air flow path provided between the plurality of glasses.

An air outlet, through which air passing through the air flow path provided inside the door is discharged, may be provided on the front side of the cabinet. Recently, the needs of consumers for differentiating the exterior design of products have increased. In order to differentiate the exterior design of the cooking appliance, research has been conducted to reduce the size of the air outlet.

DISCLOSURE

Technical Problem

The present disclosure is directed to providing a cooking appliance capable of having improved aesthetics by reducing a size of an air outlet provided in a front side of a cabinet.

The present disclosure is directed to providing a cooking appliance capable of preventing an increase in surface temperature of a door while reducing a size of an air outlet.

The present disclosure is directed to providing a cooking appliance capable of preventing an increase in flow path resistance and a reduction in air volume caused by a reduction in size of an air outlet.

Technical Solution

One aspect of the present disclosure provides a cooking appliance including a cabinet, a cooking chamber located inside the cabinet and including an open front side, a door configured to open and close the open front side of the cooking chamber, a blower fan disposed above the cooking chamber to blow air, an air outlet provided in a gap between an upper end of the door and the cabinet, a duct provided to guide the air blown by the blower fan to the air outlet, and a circulation duct provided to connect the duct and a side of the blower fan to allow a portion of the air, which moves to the air outlet by the blower fan to be re-introduced into the blower fan.

A height of an inside of the duct may be gradually reduced from the blower fan toward the air outlet.

The circulation duct may connect an upper surface of the duct adjacent to the air outlet to an upper side of the blower fan.

The door may include a door flow path provided to guide air from a lower side of the door to an upper side of the door.

The door may further include a plurality of glasses.

The door flow path may be formed between the plurality of glasses.

The door may further include a door outlet provided to discharge air, which is moved upward of the door by the door flow path, to an upper portion of the cooking chamber.

The cabinet may include an air inlet disposed to face the door outlet and provided to introduce air, which is discharged through the door outlet, into the cooking chamber.

The duct may include an inlet flow path provided to guide air from the air inlet to the blower fan, and an outlet flow path provided to guide air from the blower fan to the air outlet.

The circulation duct may include a circulation flow path provided to guide air from one side of the outlet flow path to the blower fan.

The blower fan may be configured to suck air from upper and lower sides of the blower fan, respectively, so as to suck air through the inlet flow path and the circulation flow path.

The duct may include a duct frame disposed above the cooking chamber and forming a lower surface of the inlet flow path, a first duct coupled to the duct frame and forming an upper surface of the outlet flow path, and a second duct disposed between the first duct and the duct frame and forming an upper surface of the inlet flow path and a lower surface of the outlet flow path.

The duct may further include a guide duct extending from a front end of the second duct to the air outlet.

The guide duct may be provided to cover an upper surface of the door to prevent the air inside the outlet flow path from moving toward the door outlet.

The circulation duct may include a duct inlet through which air is introduced from the duct to the circulation duct, and a duct outlet through which air is discharged from the circulation duct to the blower fan.

The duct inlet may be located in front of the air inlet.

The cabinet may include a control panel forming a front side of the cabinet together with the door.

The air outlet may be provided in a gap formed between the upper end of the door and the control panel.

A height of the gap between the upper end of the door and the control panel may be uniformly provided.

Another aspect of the present disclosure provides a cooking appliance including a cabinet, a cooking chamber located inside the cabinet and including an open front side, a door configured to open and close the open front side of the cooking chamber and including a plurality of glasses, and a door flow path formed between the plurality of glasses, a blower fan disposed above the cooking chamber to blow air, an inlet flow path provided to move air, which is discharged to an outside of the door by passing through the door flow path, to the blower fan, an outlet flow path provided to discharge air, which is introduced into the blower fan through the inlet flow path, to a front side of the cabinet, and a circulation flow path provided to move air from one side of the outlet flow path toward the blower fan.

The outlet flow path may discharge air through an air outlet provided in a gap between an upper end of the door and the cabinet.

A height of the outlet flow path may be gradually reduced toward the air outlet.

The cooking appliance may further include a duct forming the inlet flow path and the outlet flow path.

The duct may include a duct frame disposed above the cooking chamber and forming a lower surface of the inlet flow path, a first duct coupled to the duct frame and forming an upper surface of the outlet flow path, a second duct disposed between the first duct and the duct frame and forming an upper surface of the inlet flow path and a lower surface of the outlet flow path, and a guide duct extending from a front end of the second duct to the air outlet, and provided to cover an upper surface of the door to prevent the air inside the outlet flow path from moving toward the door outlet.

One end of the circulation flow path through which air is introduced from the outlet flow path may be located in front of one end of the inlet flow path through which the air discharged to the outside of the door is introduced.

Another aspect of the present disclosure provides a cooking appliance including a cabinet, a cooking chamber located inside the cabinet and including an open front side, a door configured to open and close the cooking chamber and including a plurality of glasses forming a door flow path, a blower fan configured to suck air passing through the door flow path and configured to discharge the air to a front side of the cabinet, a duct provided to guide air, which passes through the door flow path, toward the blower fan, and provided to guide air, which is blown by the blower fan, to the front side of the cabinet, and a circulation duct provided to guide a portion of air, which moves from the blower fan to the front side of the cabinet, toward the blower fan.

Advantageous Effects

A cooking appliance may have improved aesthetics by reducing a size of an air outlet provided in a front side of a cabinet.

Further, a cooking appliance may prevent an increase in surface temperature of a door while reducing a size of an air outlet.

Further, a cooking appliance may prevent an increase in flow path resistance and a reduction in air volume caused by a reduction in size of an air outlet.

MODES OF THE INVENTION

Figure 1:
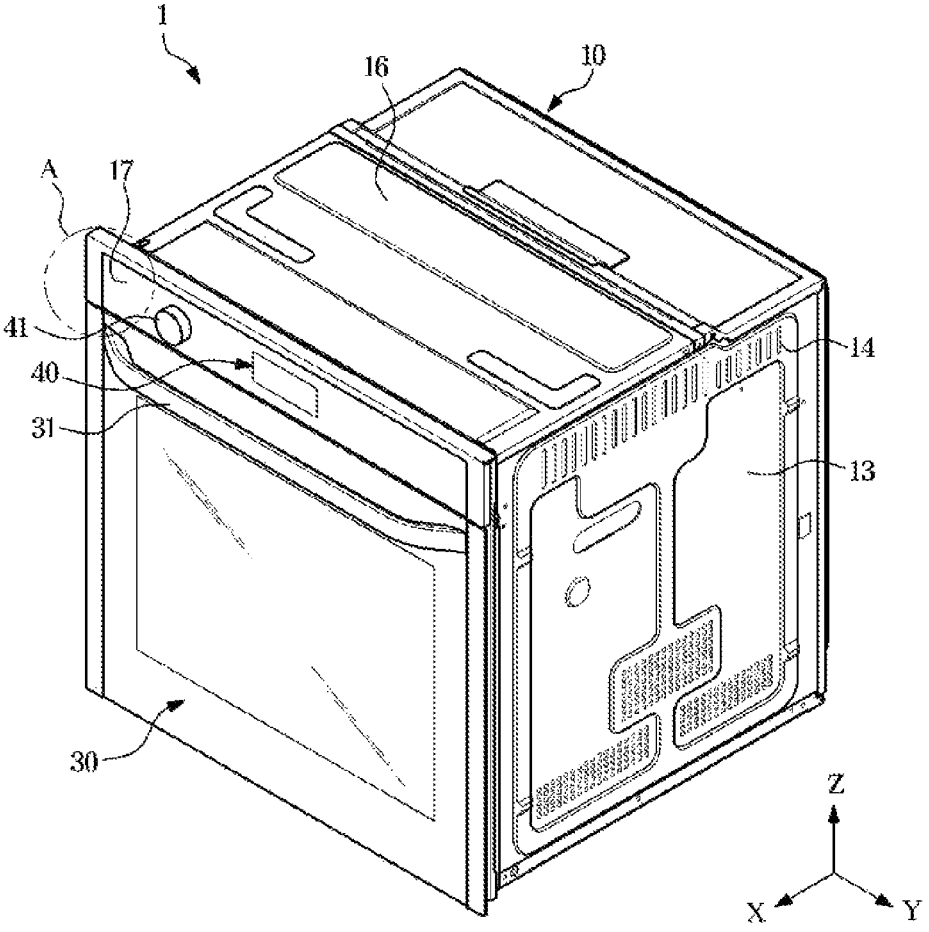
FIG. 1 is a perspective view of a cooking appliance according to one embodiment of the present disclosure.

Embodiments described in the disclosure and configurations shown in the drawings are merely examples of the embodiments of the disclosure, and may be modified in various different ways at the time of filing of the present application to replace the embodiments and drawings of the disclosure.

In addition, the same reference numerals or signs shown in the drawings of the disclosure indicate elements or components performing substantially the same function.

Also, the terms used herein are used to describe the embodiments and are not intended to limit and/or restrict the disclosure. The singular forms "a," "an" and "the" are intended to include the plural forms as well, unless the context clearly indicates otherwise. In this disclosure, the terms "including", "having", and the like are used to specify features, numbers, steps, operations, elements, components, or combinations thereof, but do not preclude the presence or addition of one or more of the features, elements, steps, operations, elements, components, or combinations thereof.

It will be understood that, although the terms first, second, third, etc., may be used herein to describe various elements, but elements are not limited by these terms. These terms are only used to distinguish one element from another element. For example, without departing from the scope of the disclosure, a first element may be termed as a second element, and a second element may be termed as a first element. The term of "and/or" includes a plurality of combinations of relevant items or any one item among a plurality of relevant items.

In the following detailed description, the terms of "front", "rear", "left side", "right side" and the like may be defined by the drawings, but the shape and the location of the component is not limited by the term.

Hereinafter exemplary embodiments of the present disclosure will be described in detail with reference to the accompanying drawings.

Figure 2:
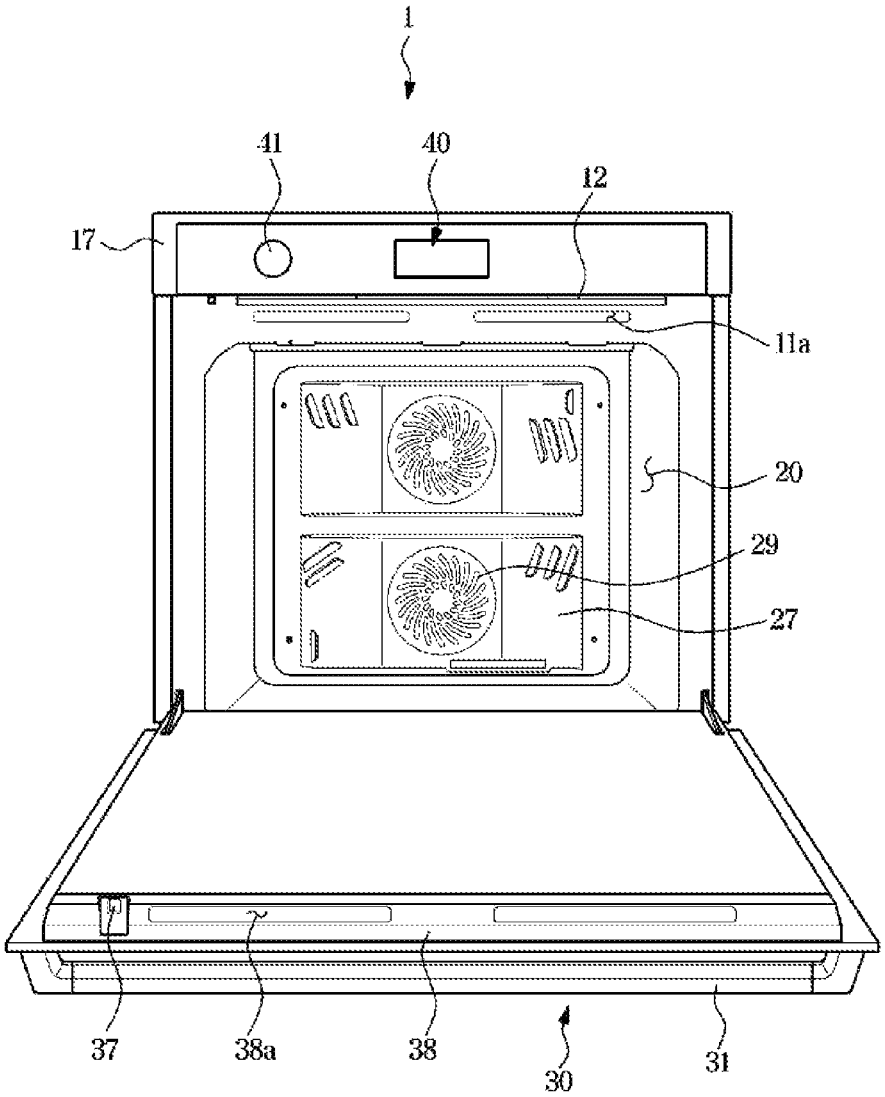
FIG. 2 is a front view of the cooking appliance according to one embodiment of the present disclosure, illustrating a state in which a door is opened.
Figure 3:
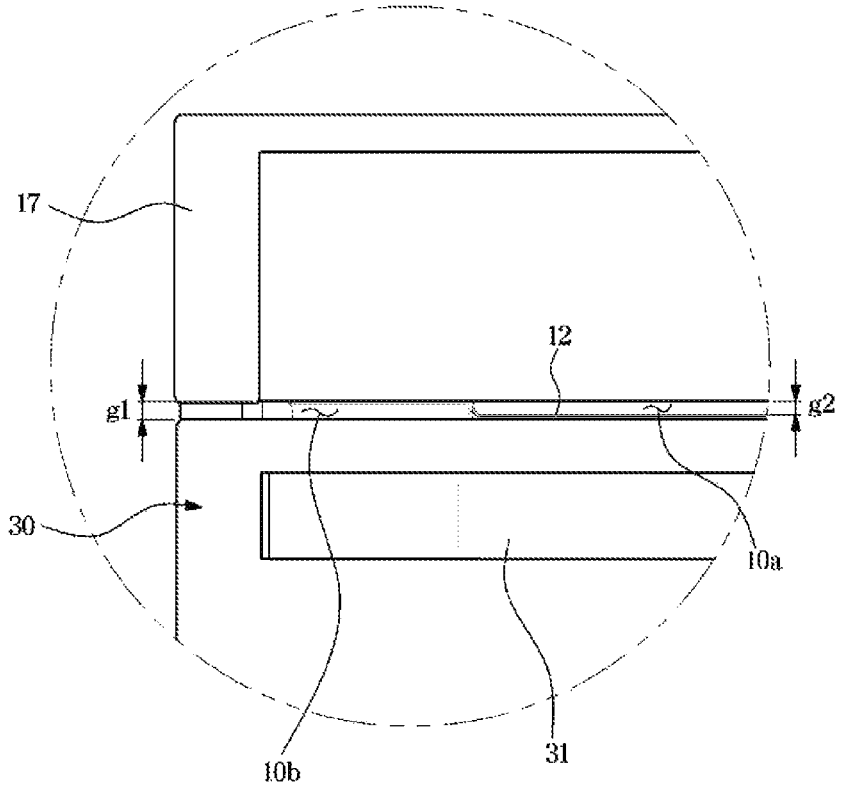
FIG. 3 is an enlarged view of a part A of FIG. 1 from a different angle.
Figure 4:
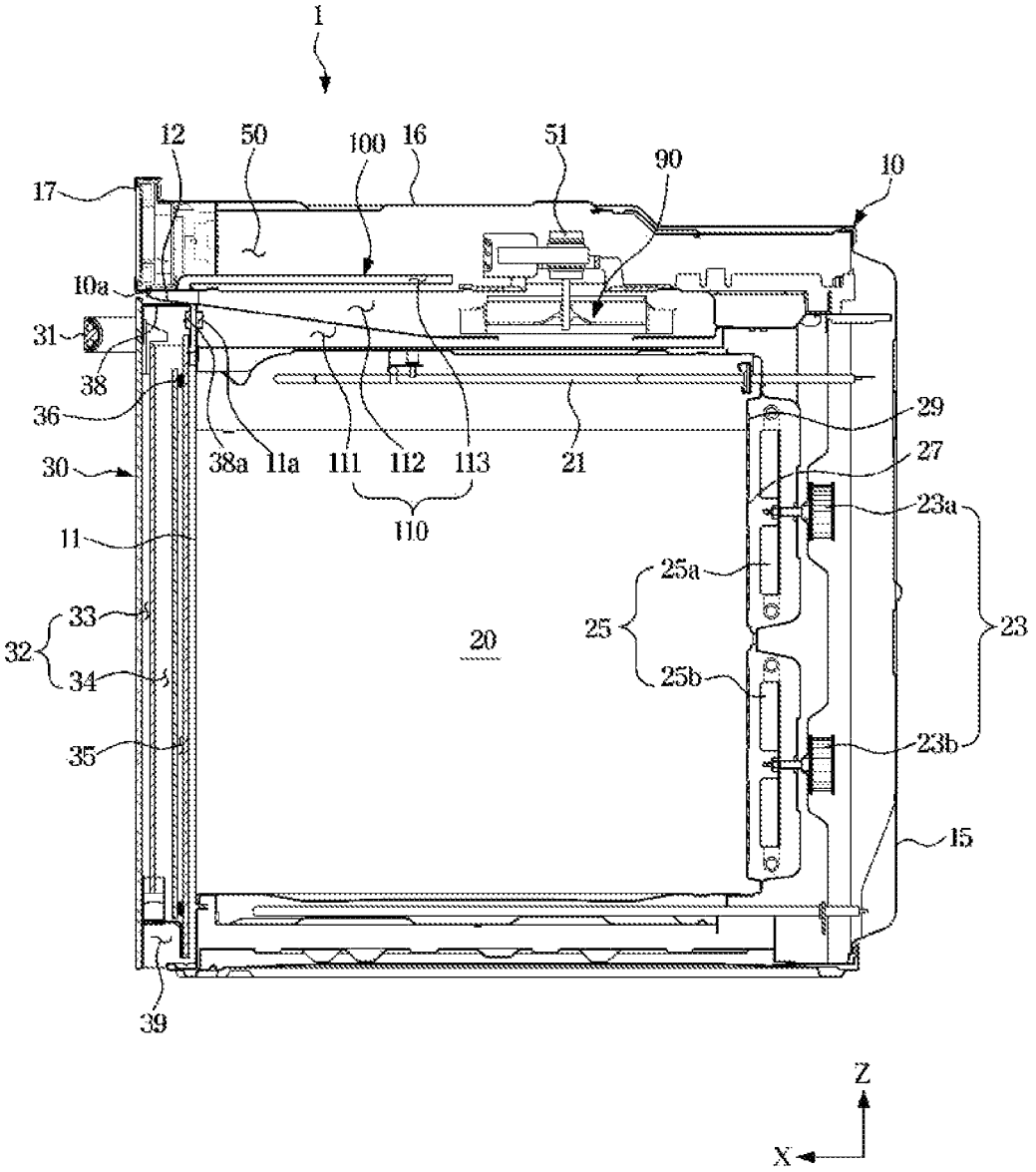
FIG. 4 is a side cross-sectional view of the cooking appliance according to one embodiment of the present disclosure.

FIG. 1 is a perspective view of a cooking appliance according to one embodiment of the present disclosure. FIG. 2 is a front view of the cooking appliance according to one embodiment of the present disclosure, illustrating a state in which a door is opened. FIG. 3 is an enlarged view of a part A of FIG. 1 from a different angle. FIG. 4 is a side cross-sectional view of the cooking appliance according to one embodiment of the present disclosure.

Hereinafter "front" refers to a X direction of FIG. 1. "Height" refers to a length in a Z direction of FIG. 1. "Lateral side" refers to a Y direction in FIG. 1.

As illustrated in FIGS. 1 to 4, a cooking appliance 1 may include a cabinet 10 forming an exterior, a cooking chamber 20 formed inside the cabinet 10 and provided with an open front side, and a door 30 formed on the front side and configured to open and close the cooking chamber 20.

The cabinet 10 may include a front panel 11 forming the front side of the cabinet 10, a side panel 13 forming a side surface of the cabinet 10, a rear panel 15 forming a rear surface of the cabinet 10, and an upper panel 16 forming an upper portion of the cabinet 10.

A control panel 17 may be provided on a front upper portion of the front panel 11 covering a front side of an electrical component compartment 50 to be described later. The control panel 17 may also be referred to as an electrical component compartment cover. A display module 40 to be described later may be mounted on the control panel 17. The front panel 11 may be provided with an air inlet 11*a* which sucks high-temperature air discharged from the inside of the door 30 when the door is in the open 30 position.

A suction member 14 may be formed on the side panel 13 to suck air into the electrical component compartment 50 to be described later. Outside air sucked into the electrical component compartment 50 through the suction member 14 may flow inside the electrical component compartment and cool an electrical component.

The cooking chamber 20 may be formed inside the cabinet 10 to have a box shape with an open front side. Food may be put in and out of the cooking chamber 20 through the open front side of the cooking chamber 20.

A plurality of supports (not shown) may be provided on opposite sidewalls of the inside of the cooking chamber 20, and a rack (not shown), on which food is placed, may be mounted on the plurality of supports.

A divider (not shown) dividing the cooking chamber 20 into a plurality of spaces may be detachably mounted on the plurality of supports. The cooking chamber 20 divided into the plurality of spaces by the divider may not have to have the same size, but may have different sizes. The divider may be formed of a heat insulating material to insulate each cooking chamber 20. Accordingly, the plurality of spaces in the cooking chamber 20 may be used in various ways according to a user's intention.

A heater 21 configured to heat food may be arranged in the cooking chamber 20, and the heater 21 may be an electric heater including an electric resistor. The heater 21 is not limited to an electric heater and may be a gas heater configured to generate heat by burning gas. Accordingly, the cooking appliance may include an electric oven and a gas oven.

A circulation fan 25 configured to circulate air in the cooking chamber 20 to evenly heat food, and a circulation motor 23 configured to drive the circulation fan 25 may be arranged at a rear of the cooking chamber 20. According to one embodiment of the present disclosure, the circulation fan 25 may include a first circulation fan 25*a* and a second circulation fan 25*b*. The circulation motor 23 may include a first circulation motor 23*a* configured to drive the first circulation fan 25*a* and a second circulation motor 23*b* configured to drive the second circulation fan 25*b*. However, the present disclosure is not limited thereto, and the number of circulation fans and circulation motors may be one or three or more.

A fan cover 27 covering the circulation fan 25 may be provided on a front side of the circulation fan 25, and a plurality of through holes 29 may be formed in the fan cover 27 to allow air to flow.

The open front side of the cooking chamber 20 may be opened and closed by the door 30, and the door 30 may be hinged to a lower portion of the cabinet 10 so as to be rotated with respect to the cabinet 10. A door handle 31 gripped by a user may be provided on a front upper portion of the door 30. A user may open and close the cooking chamber 20 by gripping the door handle 31. A door duct 38 may be provided at the upper portion of the door 30. The door duct 38 may include a door outlet 38*a* discharging high-temperature air inside the door 30 to an outside of the door 30. The door may include a lock 37 configured to allow the door 30 to be locked or unlocked with respect to the cabinet 10 according to a use mode. An air inlet 39 may be disposed on a lower portion of the door to suck outside air into the door.

The door 30 may include a door flow path 32 through which air flows into the door 30 to cool the door 30. The door 30 may include a plurality of glass layers forming the door flow path 32. The door flow path 32 may be formed between the plurality of glass layers. According to one embodiment of the present disclosure, the door 30 may include four glass layers. The door flow path 32 may include a first door flow path 33 and a second door flow path 34 positioned at a rear of the first door flow path 33. Further, the door 30 may include a closed flow path 35. The closed flow path 35 may be formed between the plurality of glasses, similarly to the door flow path 32. The closed flow path 35 may be formed by a sealing member 36 disposed along edges of the plurality of adjacent glasses. The closed flow path 35 may prevent the heat inside the cooking chamber 20 from being cooled by the door 30. The door flow path 32 may prevent the door 30 from being heated to a predetermined temperature or higher due to the heat inside the cooking chamber 20.

The cooking appliance 1 may include a display module 40 provided to display various types of operation information and allow a user to input an operation command. The display module 40 may be mounted on the control panel 17 provided on the front upper portion of the front panel 11. The control panel 17 may be provided with a manipulator 41 provided to additionally operate the cooking appliance 1.

The cooking appliance 1 may be provided with the electrical component compartment 50 accommodating electrical components (not shown) configured to control an operation of various accessories including the display module 40. The electrical component compartment 50 may be provided above the cooking chamber 20, and an insulating material (not shown) insulating the electrical component compartment 50 and the cooking chamber 20 may be arranged between the electrical component compartment 50 and the cooking chamber 20 to prevent the heat of the cooking chamber 20 from being transmitted to the electrical component compartment 50. As well as being arranged between the electrical component compartment 50 and the cooking chamber 20, the insulating material may be provided to completely cover the outside of the cooking chamber 20 to prevent the heat of the cooking chamber 20 from being transmitted to the outside of the cooking appliance 1.

Because a temperature inside the electrical component compartment 50 rises due to the heat of various electrical components, the cooking appliance 1 may include a blower fan 90 configured to circulate the air in the electrical component compartment 50 to cool the electrical component compartment 50, and a drive motor 51 configured to drive the blower fan 90. The blower fan 90 and the drive motor 51 may be located inside the electrical component compartment 50.

The cooking appliance 1 may include a flow path 110 that not only cools the inside of the electrical component compartment 50 but also cools the high-temperature air passing through the door flow path 32 and then discharges the cooled air to a front side of the cabinet 10.

The flow path 110 may include an inlet flow path 111 sucking air that passes the door flow path 32 and then is discharged to the outside of the door 30 through the door outlet 38*a*, and an outlet flow path 112 discharging air, which is introduced to the blower fan 90 through the inlet flow path 111, to the front side of the cabinet 10. A detail description will be described later.

According to the present disclosure, the cooking appliance 1 may include a circulation flow path 113 guiding air from one side of the outlet flow path 112 to an upper side of the blower fan 90. The circulation flow path 113 will be described later.

Referring to FIGS. 1 to 3, a gap may be provided between the cabinet 10 and an upper end of the door 30. Particularly, one or more gaps may be provided between a lower end of the control panel 17 and the upper end of the door 30.

The gaps may include a first region 10*a* and a second region 10*b*. The first region 10*a* is also referred to herein as an air outlet 10*a*. The second region 10*b* may indicate a region excluding the first region 10*a*.

According to one embodiment of the present disclosure, a height g2 of the first region 10*a* and a height g1 of the second region 10*b* may be equal to each other. In other words, sizes of the first region 10*a* and the second region 10*b* formed between the lower end of the control panel 17 and the upper end of the door 30 may be uniformly provided along the lateral side.

According to one embodiment of the present disclosure, the height of the first region 10*a* and the second region 10*b* may be 8 mm or less. Particularly, the height of the first region 10*a* and the second region 10*b* may be 4 mm to 8 mm. In one embodiment of the present disclosure, the first region 10*a* and the second region 10*b* may be 4 mm.

According to the present disclosure, the height of the air outlet 10*a* may be less than a height of an air outlet in a conventional cooking appliance. Due to a reduction in the height of the air outlet 10*a*, a flow resistance in the air outlet 10*a* and in a vicinity thereof may be increased and thus an amount of air that is discharged to the front side of the cabinet 10 through the air outlet 10*a* may be significantly reduced. Further, air passing through the door flow path 32 may not flow into the blower fan 90, but rather the air may flow from the blower fan 90 toward the door flow path 32. The air passing through the door flow path 32 may not be smoothly discharged toward the front side of the cabinet 10, and a surface temperature of the door 30 may be increased. When the surface temperature of the door 30 is greater than or equal to a predetermined temperature, a safety regulation may not be satisfied.

According to the present disclosure, it is possible to provide the cooking appliance with improved aesthetics by reducing the size of the air outlet 10*a*. The size of the air outlet 10*a* may particularly refer to the height of the air outlet 10*a*. It is possible to provide the cooking appliance capable of preventing an increase in the surface temperature of the door 30 while reducing the size of the air outlet 10*a*. In addition, the cooking appliance may prevent the increase in the flow resistance and the reduction in the air volume caused by the reduction in the size of the air outlet 10*a*.

Figure 5:
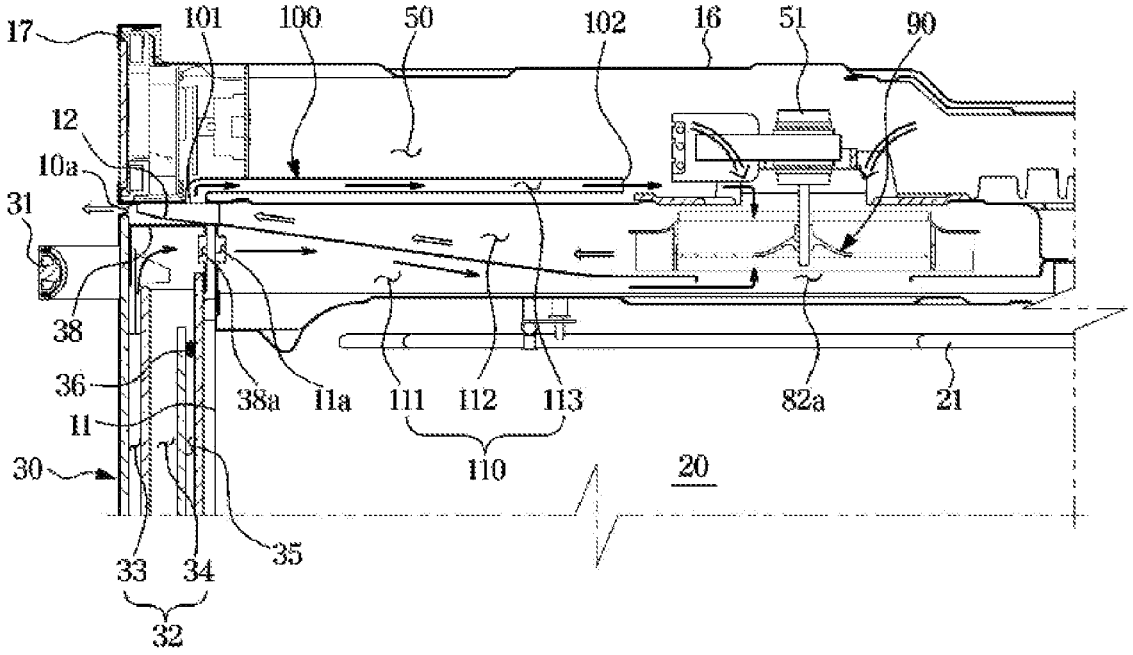
FIG. 5 is an enlarged view of a part of FIG. 4, illustrating an air flow in a flow path of the cooking appliance according to one embodiment of the present disclosure.

FIG. 5 is an enlarged view of a part of FIG. 4, illustrating an air flow in a flow path of the cooking appliance according to one embodiment of the present disclosure.

Hereinafter the flow of air in the cooking appliance according to one embodiment of the present disclosure will be described in detail with reference to FIG. 5.

Referring to FIG. 5, air introduced into the door inlet 39 (refer to FIG. 4) may move upward along the door flow path 32 and may be discharged to the outside of the door 30 through the door outlet 38*a*.

The front panel 11 may be provided with the air inlet 11*a* disposed to face the door outlet 38*a*. Air discharged to the outside of the door 30 through the door outlet 38*a* may be introduced into the inlet flow path 110 through the air inlet 11*a*. Air on the inlet flow path 110 may be introduced into the blower fan 90 by the blower fan 90 configured to suck air in opposite directions. The air moving along the inlet flow path 110 may be introduced into the blower fan 90 through a duct hole 82*a* provided under the blower fan 90.

The blower fan 90 may be configured to suck air in opposite directions. The blower fan 90 may suck air from an upper side of the blower fan 90, and at the same time, suck air from a lower side of the blower fan 90. Therefore, the air moving along the inlet flow path 110 may be sucked from the lower side of the blower fan 90 to the blower fan 90, and the air inside the electrical component compartment 50 may be sucked from the upper side of the blower fan 90 to the blower fan 90.

Air sucked into the blower fan 90 may be discharged to the lateral side of the blower fan 90. The air discharged by the blower fan 90 may move along the outlet flow path 112. The outlet flow path 112 may be located above the inlet flow path 111. The outlet flow path 112 may extend from the blower fan 90 to the air outlet 10*a*. The outlet flow path 112 may be provided such that a height of the outlet flow path 112 is gradually reduced from the blower fan 90 toward the air outlet 10*a*.

As described above, according to the present disclosure, the height of the air outlet 10*a* is less than the height of the air outlet in comparison with the conventional manner, and the height of the outlet flow path 112 is gradually reduced toward the air outlet 10*a*. As the height of the air outlet 10*a* is reduced, the flow resistance in the outlet flow path 112 adjacent to the air outlet 10*a* may be increased and the air volume may be reduced. In order to prevent an increase in the surface temperature of the door 30 caused by the increase of the flow resistance and the reduction of the air volume, the cooking appliance 1 according to the present disclosure may include the circulation flow path 113.

The circulation flow path 113 may connect one side of the outlet flow path 112 adjacent to the air outlet 10*a* to the upper portion of the blower fan 90. One end of the circulation flow path 113 may be connected to an upper surface of the outlet flow path 112, and the other end of the circulation flow path 113 may be connected to the upper side of the blower fan 90. As the circulation flow path 113 is provided, a portion of air at the outlet side of the outlet flow path 112 having an increased flow path resistance is reintroduced into the blower fan 90 through the circulation flow path 113. Accordingly, the flow resistance of the outlet side of the outlet flow path 112 may be reduced, and the remaining air on the outlet side of the outlet flow path 112 may be discharged to the front of the cabinet 10 through the air outlet 10*a*.

In summary, the air passing through the door flow path 32 may flow into the outlet flow path 112 through the inlet flow path 111 and the blower fan 90, a portion of the air may be reintroduced into the blower fan 90 by the circulation flow path 113, and the remaining air may be discharged to the front of the cabinet 10 through the air outlet 10*a*. That is, the air introduced through the door inlet 39 may be smoothly discharged through the air outlet 10*a*, and the air in the door flow path 32 may move smoothly. As the air moves through the door flow path 32, the door 30 may be cooled, and the increase in the surface temperature of the door 30 may be prevented.

Meanwhile, the circulation flow path 113 may include a duct inlet 101 through which air is introduced into the circulation flow path 113 and a duct outlet 102 through which air is discharged from the circulation flow path 113. The duct inlet 101 may be connected to the upper surface of the outlet flow path 112, and the duct outlet 102 may be connected to the upper side of the blower fan 90.

According to one embodiment of the present disclosure, the duct inlet 101 may be provided to be located in front of the air inlet 11*a*. This is because the air inlet 11*a* is provided in the front panel 11 and the outlet flow path 112 has a very small height in front of the front panel 11, and thus the flow resistance increases in front of the front panel 11. Therefore, in order to allow the circulation flow path 113 to operate more efficiently, the duct inlet 101 may be located in front of the air inlet 11*a*.

A guide duct 12 may be provided at an outlet side of the outlet flow path 112. The guide duct 12 may be formed integrally with a second duct 82 to be described later, or may be formed to be separated from the second duct 82. The guide duct 12 may be provided to prevent air, which moves along the outlet flow path 112, from moving to the door outlet 38*a* of the door 30. The guide duct 12 may be provided to cover the upper surface of the door 30.

Figure 6:
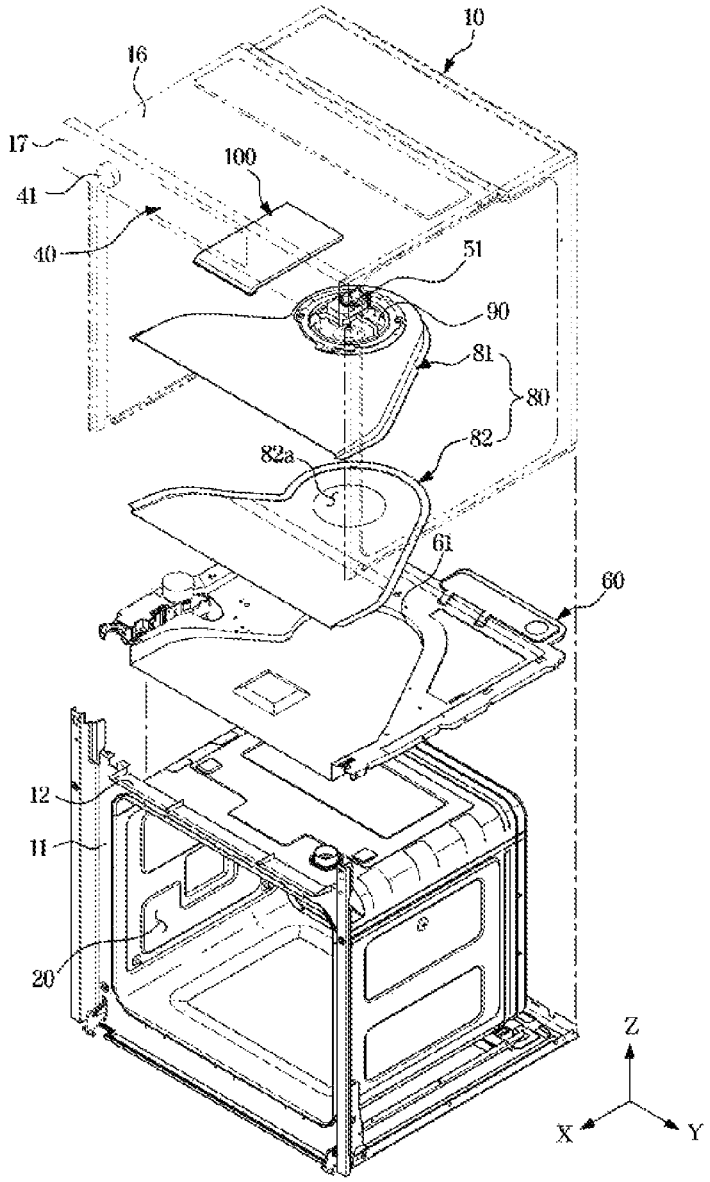
FIG. 6 is an disassembled view of a duct in the cooking appliance according to one embodiment of the present disclosure.

FIG. 6 is an disassembled view of a duct in the cooking appliance according to one embodiment of the present disclosure.

Hereinafter a structure of the duct forming the flow path 110 of the present disclosure will be described in detail with reference to FIG. 6.

Referring to FIG. 6, the cooking appliance 1 may include a duct frame 60 covering an upper portion of the cooking chamber 20 and forming a lower surface of the electrical component compartment 50, a duct 80 coupled to the duct frame 60, and a circulation duct 100.

The duct frame 60 may form the lower surface of the electrical component compartment 50. In addition, the duct frame 60 may be provided to cover the upper surface of the cooking chamber 20. The duct frame 60 may include a duct groove 61 forming a lower surface of the inlet flow path 111. The duct groove 61 may be formed by recessing a portion of the duct frame 60 downward.

The duct 80 may include a first duct 81 to which the drive motor 51 and the blower fan 90 are mounted, and the second duct 82 disposed between the first duct 81 and the duct frame 60. The first duct 81 may be coupled to the duct frame 60. The first duct 81 may form an upper surface of the outlet flow path 112.

The second duct 82 may form an upper surface of the inlet flow path 111 and a lower surface of the outlet flow path 112. The second duct 82 may include the duct hole 82*a* through which air moving along the inlet flow path 111 is introduced into the blower fan 90 from the lower side of the blower fan 90. The duct hole 82*a* may be provided to penetrate the second duct 82.

The circulation duct 100 may include the duct inlet 101 and the duct outlet 102. The duct inlet 101 may be disposed to be connected to the upper surface of the outlet flow path 112. The duct outlet 102 may be disposed to be connected to the upper portion of the circulation fan 90. The circulation duct 100 may be disposed above the duct 80.

The guide duct 12 may extend from a front end of the second duct 82 to the air outlet 10*a*. As described above, the guide duct 12 may be provided integrally with the second duct 82, unlike that illustrated in the drawings. The guide duct 12 may be provided to cover the upper surface of the door 30. The air inlet 11*a* may be provided under the guide duct 12.

Figure 7:
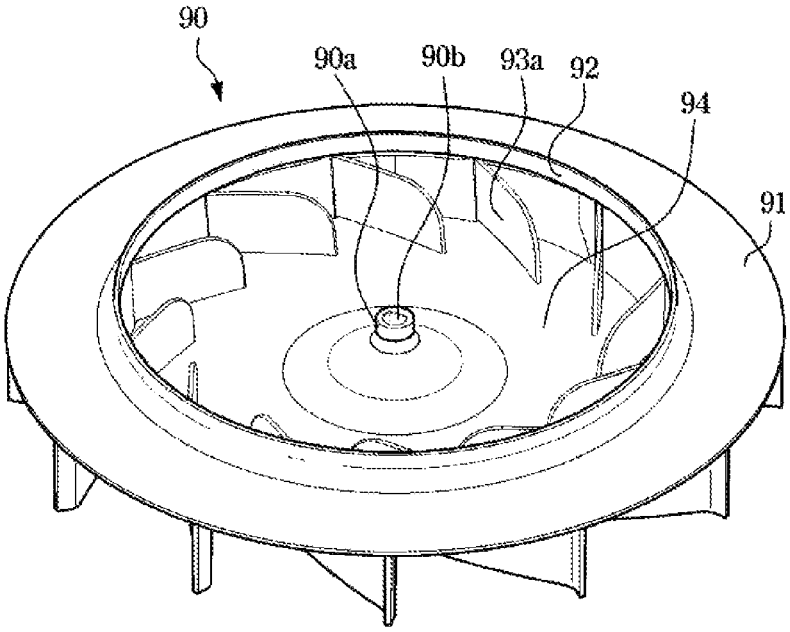
FIG. 7 is a view of a blower fan separated from the cooking appliance according to one embodiment of the present disclosure.
Figure 8:
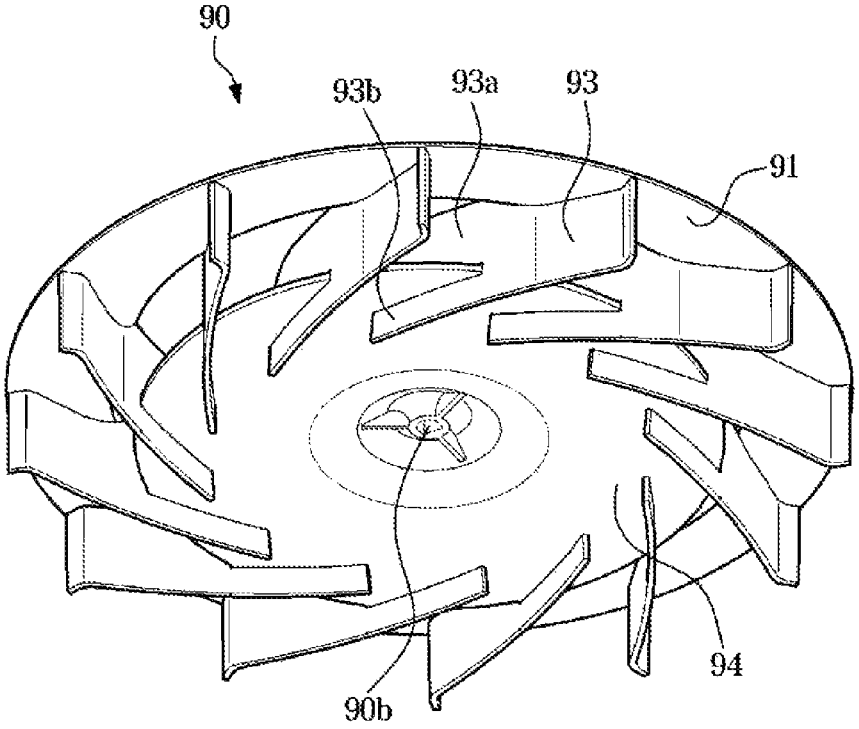
FIG. 8 is a view of the blower fan shown in FIG. 7 from a different angle.

FIG. 7 is a view of a blower fan separated from the cooking appliance according to one embodiment of the present disclosure. FIG. 8 is a view of the blower fan shown in FIG. 7 from a different angle.

Hereinafter the blower fan of the present disclosure will be described with reference to FIGS. 7 and 8.

Referring to FIGS. 7 and 8, the blower fan 90 according to one embodiment of the present disclosure may be configured to suck air in opposite directions. Particularly, the blower fan 90 may be provided to suck air from the upper and lower sides of the blower fan 90 and discharge the air laterally.

The blower fan 90 may include a shaft coupler 90*a* provided to allow a shaft of the drive motor 51 to coupled thereto. The shaft coupler 90*a* may include a shaft coupling hole 90*b* into which the shaft is inserted.

The blower fan 90 may include a first body 91 provided in the form of a disk having a larger diameter than the duct hole 82*a*, a first hole 92 formed in a center of the body 91, and a plurality of blades 93, and a second body 94 corresponding to the size of the duct hole 82*a*. Air may be introduced into the blower fan 90 from the upper side of the blower fan 90 through the first hole 92.

The blade 93 may include a first blade member 93*a* and a second blade member 93*b*. The first blade member 93*a* may generate a suction force for sucking air from the upper side of the blower fan 90 to the blower fan 90. The second blade member 93*b* may generate a suction force for sucking air from the lower side of the blower fan 90 to the blower fan 90. According to one embodiment of the present disclosure, the first blade member 93*a* may be provided to be larger than the second blade member 93*b*.

Figure 9:
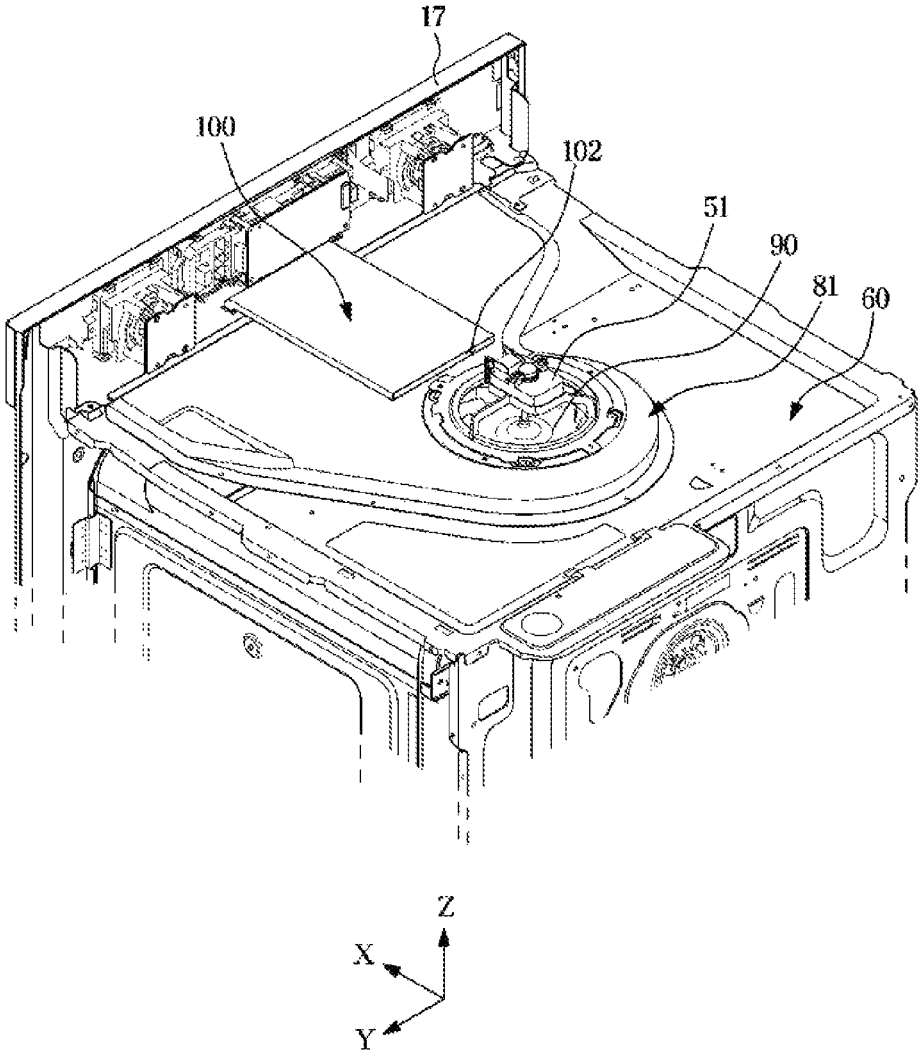
FIG. 9 is a view of an inside of an electrical component compartment in the cooking appliance according to one embodiment of the present disclosure.

FIG. 9 is a view of an inside of an electrical component compartment in the cooking appliance according to one embodiment of the present disclosure.

Referring to FIG. 9, the circulation duct 100 may be disposed in the center of the electrical component compartment 50. At this time, the center of the electrical component compartment 50 refers to the center of the electrical component compartment 50 with respect to a left and right direction Y. Air discharged by the blower fan 90 may have the greatest increase in flow path resistance at the center of the outlet flow path 112. In order to reduce the flow resistance so as to increase the air volume, the circulation duct 100 may be disposed in the center of the electrical component compartment 50 as the upper side of the outlet flow path 112.

While the present disclosure has been particularly described with reference to exemplary embodiments, it should be understood by those of skilled in the art that various changes in form and details may be made without departing from the spirit and scope of the present disclosure.

The invention claimed is:

1. A cooking appliance, comprising:

a cabinet;

a cooking chamber located inside the cabinet and having an open front side;

a door configured to open and close the open front side of the cooking chamber;

a blower fan disposed above the cooking chamber and configured to blow air;

an air outlet disposed in a gap between an upper end of the door and the cabinet;

a duct provided to guide the air blown by the blower fan to the air outlet;

a circulation duct provided to connect the duct and a side of the blower fan to allow a portion of the air, which moves to the air outlet by the blower fan, to be re-introduced into the blower fan;

wherein the cabinet includes an air inlet disposed to introduce air discharged from the door into the cooking chamber;

wherein the duct includes an inlet flow path provided to guide air from the air inlet to the blower fan and an outlet flow path provided to guide air from the blower fan to the air outlet, and wherein the circulation duct connects the side of the blower fan to the air outlet, disposed in the gap between the upper end of the door and the cabinet.

2. The cooking appliance of claim 1, wherein a height of an inside of the duct is gradually reduced from the blower fan toward the air outlet.

3. The cooking appliance of claim 1, wherein the circulation duct connects an upper surface of the duct adjacent to the air outlet to an upper side of the blower fan.

4. The cooking appliance of claim 1, wherein the door includes a door flow path provided to guide air from a lower side of the door to an upper side of the door.

5. The cooking appliance of claim 4, wherein the door further comprises a plurality of glass layers, and wherein the door flow path is formed between two of the plurality of glass layers.

6. The cooking appliance of claim 4, wherein the door further includes a door outlet provided to discharge air, which is moved upward through the door flow path, to an upper portion of the cooking chamber.

7. The cooking appliance of claim 6, wherein the air inlet is disposed to face the door outlet and is configured to introduce air discharged from a central portion of the door outlet into the cooking chamber.

8. The cooking appliance of claim 7, wherein the circulation duct includes a circulation flow path provided to guide air from one side of the outlet flow path to the blower fan.

9. The cooking appliance of claim 8, wherein the blower fan is configured to suck air from upper and lower sides of the blower fan, respectively, to suck air through the inlet flow path and the circulation flow path.

10. The cooking appliance of claim 8, wherein the duct comprises:

a duct frame disposed above the cooking chamber and forming a lower surface of the inlet flow path;

a first duct coupled to the duct frame and forming an upper surface of the outlet flow path; and a second duct disposed between the first duct and the duct frame and forming an upper surface of the inlet flow path and a lower surface of the outlet flow path.

11. The cooking appliance of claim 10, wherein the duct further includes a guide duct extending from a front end of the second duct to the air outlet, wherein the guide duct is provided to cover an upper surface of the door to prevent the air inside the outlet flow path from moving toward the door outlet.

12. The cooking appliance of claim 7, wherein the circulation duct includes a duct inlet through which air is introduced from the duct to the circulation duct, and a duct outlet through which air is discharged from the circulation duct to the blower fan, and wherein the duct inlet is located in front of the air inlet.

13. The cooking appliance of claim 1, wherein the cabinet comprises a control panel forming a front side of the cabinet together with the door, and wherein the air outlet is provided in a gap formed between the upper end of the door and the control panel.

14. The cooking appliance of claim 13, wherein a height of the gap between the upper end of the door and the control panel is uniformly provided.

* * * * *